US005722389A

United States Patent [19]

Cranberg

[11] Patent Number: 5,722,389

[45] **Date of Patent: *Mar. 3, 1998**

[54] PULLOUT FIREPLACE GRATE

[76] Inventor: Lawrence Cranberg, P. O. Box 3434, Austin, Tex. 78764

[ * ] Notice: The terminal 11 months of this patent has been disclaimed.

[21] Appl. No.: 354,513

[22] Filed: Dec. 13, 1994

[51] Int. Cl.[6] ..... F24B 1/193

[52] U.S. Cl. ..... 126/540; 126/152 R; 126/152 B

[58] Field of Search ..... 126/540, 152 R, 126/174, 169, 152 B

[56] References Cited

U.S. PATENT DOCUMENTS

| | | | |
|---|---|---|---|
| 526,629 | 9/1894 | Lawlor | 126/540 |
| 723,705 | 3/1903 | Nunan | 126/174 |
| 791,947 | 6/1905 | Fonoli | 126/152 R |
| 807,303 | 12/1905 | Moyat | 126/152 R |
| 1,118,501 | 11/1914 | Laughlin | 126/541 |
| 3,439,667 | 4/1969 | Stone . | |
| 3,665,894 | 5/1972 | Jones . | |
| 3,670,714 | 6/1972 | Eyges . | |
| 3,830,218 | 8/1974 | Shelton . | |
| 3,842,763 | 10/1974 | Korting . | |
| 4,069,808 | 1/1978 | Cranberg | 126/541 |
| 4,091,750 | 5/1978 | Thiesler et al. . | |
| 4,161,168 | 7/1979 | Cagle . | |
| 4,326,496 | 4/1982 | Bentrem . | |
| 4,429,681 | 2/1984 | Love . | |
| 4,671,190 | 6/1987 | Moreau . | |
| 4,981,090 | 1/1991 | Andersen . | |
| 5,010,874 | 4/1991 | Toth . | |

*Primary Examiner*—Larry Jones

[57] ABSTRACT

An apparatus is described that enables the user to pull a fireplace grate partially out of a fireplace for ease of loading with fuel, and then to push the fuel-loaded grate back into the fire-making position. The apparatus consists of a platform on whose top surface are receptacles which receive the feet of the grate. The platform engages and slides on rails attached to a base resting on the floor of a fireplace.

10 Claims, 1 Drawing Sheet

PULLOUT FIREPLACE GRATE

BACKGROUND OF THE INVENTION

A study for the U.S. Consumer Products Safety Commission by W. W. Zamula, "Room Heating Equipment Exposure Survey", March, 1989, shows that there are about 25 million fireplaces in America, but that they are little used for home heating. An example is the White House itself; which has 27 fireplaces but none has been used for wood-burning in the administration of the current President since Inauguration Day. The meager use of wood-burning fireplaces is an anomaly at a time when alternative energy sources are being eagerly sought to replace domestic supplies of fossil fuels, which are rapidly diminishing and will be gone in America early in the 21st century.

An estimate by a local mason in Austin, Tex., is that a fireplace costs about $4000 to build, so that the replacement value of America's fireplaces is in the neighborhood of 100 billion dollars—a huge sum to be playing a merely ornamental role in American homes. The potential value of this investment as a heat source is underscored by the advent of the present inventor's Slot Fire, U.S. Pat. No. 4069808, "Apparatus and Method for Combustion", which delivers about 5 kilowatts of radiant power, or a startling 125,000 megawatts for the country's installed fireplaces.

Experience of the last 20 years in the marketplace with introduction of the present inventor's Slot Fire invention teaches us the complexity of the issues involved in bringing America's fireplaces into more effective use. Some of the difficulties are beyond the reach of invention in the technical sense, and require suitable public and educational policies and commercial alliances and relationships.

In particular, it is necessary that the public learn that there is a very strong current of misinformation about fireplaces which maintains they are energy-counterproductive in a centrally heated home—that the warm air lost up the flue exceeds the heat benefit from the fire. This argument is made by promoters of various replacements for fireplaces, such as woodstoves, and even more effectively by their surrogates and dupes. In fact, the value of fireplaces as a means of conserving fuel in centrally heated homes was established by a World War II Study by K. Konzo and W. S. Harris of the University of Illinois Engineering Experiment Station in November, 1943, "Fuel Savings Resulting from Closing of Rooms and From Use of a Fireplace", Bulletin No. 348. The findings of the Study have never been disputed but have been substantially misrepresented to the public.

It is particularly unfortunate that much of the misinformation comes from those who promote use of woodstoves. Without citing evidence, they have fostered the argument that the fireplace is energy counter-productive and that the answer to the alleged inefficiencies of fireplaces is an "air-tight" woodstove. That argument has been so misleading and pervasive as to warrant coining the term "Anti-Fireplace Hoax" to describe it. At the same time the woodstove has proven itself to be such a serious source of chimney fires and atmospheric pollution as to have come under the regulation of the U.S. Consumer Products Safety Commission and the Environmental Protection Agency respectively, while fireplaces have not come under regulation by either, and the popularity of woodstoves is rapidly decreasing.

The fading of woodstoves as competitors of wood-burning fireplaces has been followed by a remarkable turn of events. Fireplaces are now being promoted as gas-burning appliances, with imitation ceramic or concrete logs placed on the hearth to simulate a wood fire. The supreme irony in this turn of events is that the wood-burning fireplace was an alternative to the rapidly depleting supply of fossil fuel, and that it is now being used to expedite that depletion!

The popularity of gas-burning in the fireplace with imitation logs must be seen as a back-handed tribute to the popularity of the authentic wood-burning fireplace, but also as an indication of the relative inconvenience of wood-burning.

The value of fireplaces as heating devices was very substantially enhanced by the present inventor's U.S. Pat. No. 4,069,808, "Apparatus and Method for Combustion". The present patent application discloses improvements in the prior apparatus based on 20 years of experience in the marketplace with that apparatus. The improvements greatly facilitate loading of the grate with wood fuel, greatly enhance its life against corrosion, and materially facilitate ash removal. To preserve and popularize the basic benefits of wood-burning as a source of alternative energy, the improvements proposed herein are both timely and necessary.

SUMMARY OF THE INVENTION

The primary objects of the invention are to assure easier handling of wood fuel required for proper Slot Fire operation, and assure longer life for fireplace grates generally, and in particular for the TEXAS FIREFRAME GRATE. This is the federally registered trademark for the fireplace accessory described in U.S. Pat. No. 4,069,808, that makes the Slot Fire a fire-making method proven by 20 years of experience to be decisively superior to traditional, conventional methods. Easier ash removal is a third objective of this invention.

It is an important objective of the grate pullout device disclosed herein to enable one to use back logs large enough (10 inches or more in diameter) that it will be practical with a single back log to operate the fire on an intermittent active- or stand-by basis for 24 hours or more. With the pullout grate according to the present invention, large weights of fuel logs are lifted and lowered vertically by arm and knee action and avoid the stresses to the spinal column of cantilever action. And lifting can be avoided altogether if a ramp is improvised to roll a large log from the floor onto the grate in the pull-out position.

It is pertinent to point out what is meant by "stand-by" operation. Any fire may be allowed to smolder—that is, burn slowly, or be effectively in a "stand-by" mode—the term "banking a fire" is sometimes used—and then be fed fresh fuel to increase its combustion rate and heat production. If the lower front logs of the Slot Fire are allowed to burn out without replacement, the hot coals which have been formed on the back log are the means which enable full flaming and heat production to occur rapidly when those front logs are replaced. Hence the key to the initial life of a Slot Fire is the size of its back log. Although the back log itself can be replaced and a Slot Fire continued indefinitely, if we assume that one's object is to have a 24-hour fire with a single back log, the size of that log is critical, and the convenient means of installing it described in this invention is a matter of substantial practical usefulness and importance.

Replacement of the front and upper logs of the Slot Fire can be accomplished with ease since they weigh much less than the back log. Thus it is not contemplated that the pullout feature will be used except for initial loading of the back log, and that the grate will not be pulled out at all during operation of the fire.

When fireplaces provide a major source of home heat in the cold season, as envisaged in this and the present inventor's prior invention of the Slot Fire, the longevity of the grate becomes a matter of importance. What limits the lifetime of grates is corrosion by the chemical ingredients of wood ashes and deformation of the grate structure. Both effects are strongly accelerated when the elements of the grate are at high temperature. It is a second object of this invention to extend the lifetime of fireplace grates generally, and of the TEXAS FIREFRAME GRATE family in particular.

This invention provides a design of pullout device which at the same time solves the two problems which cause early burn-out of grates—contact with wood ashes, which often have corrosive chemical interaction with the iron used universally in grates, and high temperature, which accelerates the rate of corrosive interaction and leads to deformation of the grate structure. It should be kept in mind that the temperatures of a fireplace grate increase from front to back, and from the sides toward the middle, so that the hottest part is the middle of the back portion.

Typically a grate is supported on relatively slender metal legs that rest on a floor of thermally insulating brick. The total cross-sectional area of the legs which support a grate in contact with the floor of the fireplace may be no more than 2 square inches. Thus, thermally speaking, a grate is virtually suspended in air-filled space. Conduction of heat away from the hottest portions of the grate is therefore severely limited. Conduction cooling also occurs by air inflow to the grate from the room, but this is subject to constriction as ashes accumulate under the grate. Cooling by radiation is efficient only at elevated temperatures, which is the very condition to be avoided. Thus a grate can literally cooks itself to death in a time period which may be as short as one year under very heavy, daily use.

This invention radically increases heat conduction away from the hottest portions of the grate by establishing good thermal contact between the feet of the grate and the thermally conducting platform on which they rest. More important still is the concept of making good thermal contact between the grate support member of the Texas Fireframe grate, which has a flat, vertical area of 2×21 inches (42 square inches), and a heat-conducting member of the base of the grate pullout and life-extender apparatus described in the preferred embodiment of this invention. And finally, instead of a 2 square-inch area of contact between the grate and the floor of the fireplace, the area of contact of the base of the preferred embodiment of the pullout and life-extender apparatus with the floor of the fireplace is 45 square inches. By lowering peak temperatures particularly in that middle part of the grate support member, which otherwise reaches very high temperatures, this invention assures reliable extension of the life of the grate against corrosion and deformation so that its lifetime may be responsibly warranted for extended periods even with heavy, daily usage.

Elevation of the grate above the floor of the fireplace by the base and pullout platform assures access of cooling room-air to the back of the fireplace in the space between the top of an accumulating ash heap and the bottom of the grate, and makes ash-cleaning less frequently necessary to preserve air access. An elevation of 4 inches also assures clearance of the platform in its pulled-out position over the barrier that might be presented by the frame of commercial glass doors that are in place in front of many American fireplaces. But the means of cooling the grate by thermal conduction through solid materials described above should be more reliable and effective in controlling grate temperature than air cooling.

DESCRIPTION OF THE PREFERRED EMBODIMENTS

Figure 1:
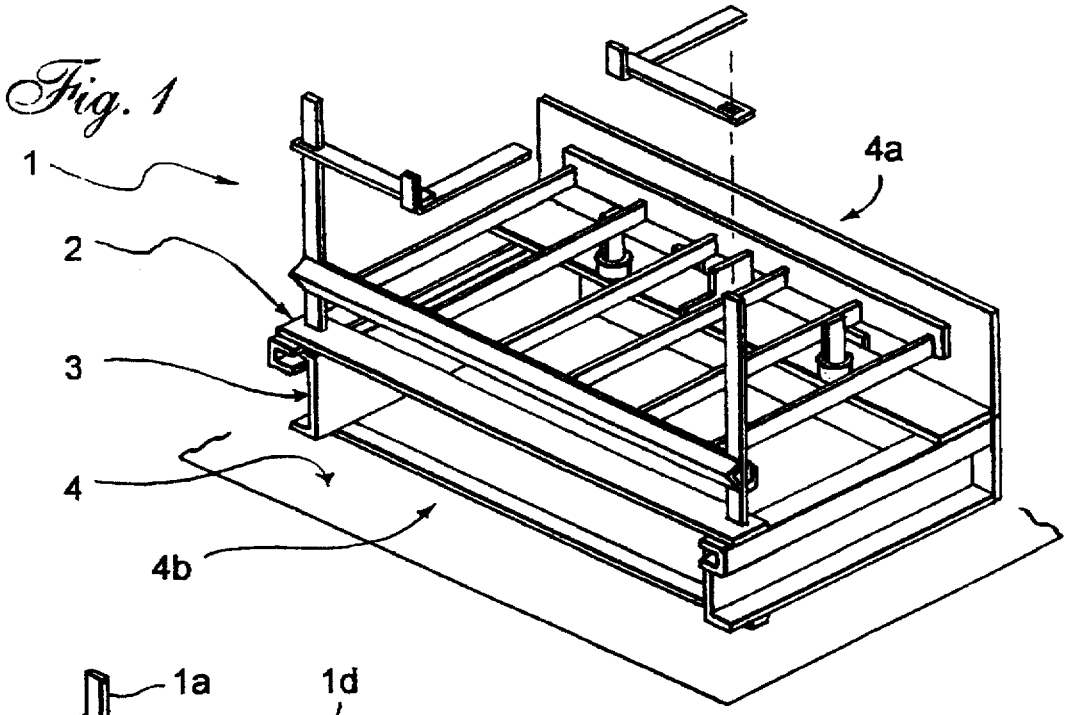
FIG. 1 is an isometric drawing of the pullout fireplace grate according to the principles of this invention.
Figure 2:
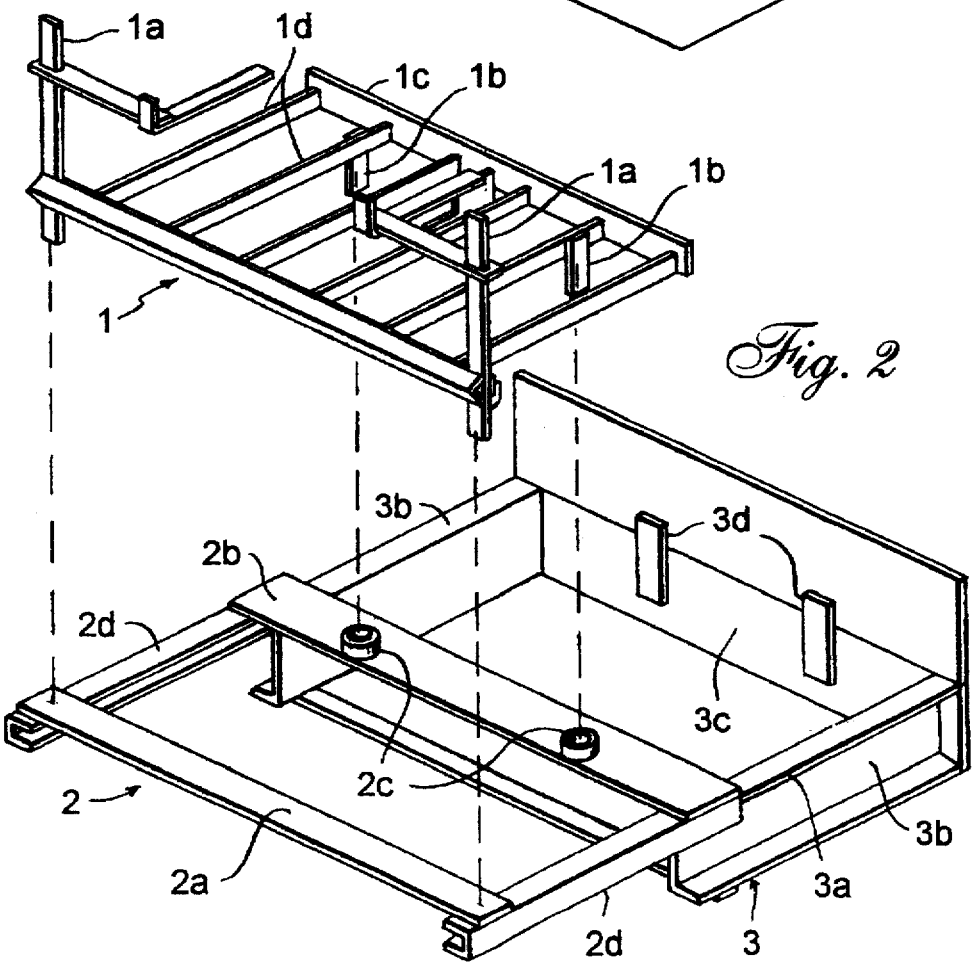
FIG. 2 is a partially exploded isometric drawing of the pullout fireplace grate shown in FIG. 1.

As shown in FIG. 1, a TEXAS FIREFRAME GRATE, Model KS-25, 1, designed to support fuel to be used in the fireplace, is removably attached to a metal grate-support platform 2, which is removably attached to a base, 3, that rests on the floor of the fireplace 4.

The grate has front legs 1*a*, rear legs 1*b*, and a grate support structure 1*c*, to which a plurality of log-supporting ribs 1*d* are attached.

The platform, 2, consists of a front cross piece 2*a*, which supports the front legs, 1*a*, of the grate, and a back cross-piece, 2*b*, fitted with receptacles 2*c* which removably engage the back legs, 1*b*, of said grate. Said cross pieces are both welded to a left and right channel 2*d*, which ride on and are engaged by the edges, 3*a*, of the metal base rails, 3*b*, attached to the base, 3, which itself rests on the floor of the fireplace, 4.

To pull out the grate from the fireplace while the base remains in place, the platform, 2, is easily movable by an in-and-out sliding motion, like the familiar drawer in a cabinet, by means of platform channels 2*d*, which slide easily on the fixed rails 3*c* of the base when lubricated by graphite lubricant. The base, 3, is fixed in the fireplace by inertia and by friction, or by special means of attachment to the floor of the fireplace. The metal base, 3, supports and elevates the grate, 1, and its sliding platform, 2, providing at least four inches of elevation of the grate above the floor of the fireplace in addition to the elevation supplied by the platform and by the two rear legs, 1*a*, and the two front legs 1*b*, of the grate itself; for a total elevation of the grate, 1, above the floor of the fireplace 4 of at least seven inches.

The metal base and platform provide an added function of heat transfer which is novel and unique to this invention, and contributes to extension of grate lifetime by moderating its temperatures during operation. The base 3 and platform 2 described herein are fabricated of heat-conducting material such as iron, in thicknesses which assure efficient heat transfer by thermal conduction. The base and platform, which extend from the back of the fireplace to the front, provide an efficient and novel means of conducting heat from the high temperature back of the fireplace, 4*a*, to the much cooler front portion 4*b*, and to the fireplace floor, 4, thereby moderating the temperatures reached at the back by the grate support member 2*b* and its environment.

The temperature-moderating role of the base 3 is particularly important. The base consists of two substantial elements of iron channel, 3*b*, whose upper edges are the rails which engage the sliding components of the support platform. These elements are connected at the back of the fireplace by a substantial iron plate, 3*b*, to make a "U" shaped structure opening to the front of the fireplace, 4*b*. This structure not only supports the platform, but it acts as a counterweight to the grate and its load when they are in the pullout position. Heat transfer from the grate to the base is by radiation and by conduction, particularly through the back legs of the grate, 1*a*, to the sliding support, 2, and thence to the base, 3, with its large area of contact with the floor of the fireplace 4. To assure fullest thermal contact between the hottest portion of the grate, which is the grate support member, 1*c*, and the base 3, the latter has an upward extending section, 3*c*, detachable for ease of packaging by means of fingers 3d. Element 3*c* makes thermal contact with the grate support member 1c when the grate 1 is pushed fully into its operational position in the fireplace. The user of this appliance should readily recover its cost by extending the life of the grate. The grate and its support should be thought of as a thermally integral, functional unit. The unit weighs about 60 pounds.

The subject invention lends itself to use with almost any design of grate now in general use in the marketplace, with the same benefits described above: ease of fuel loading and extension of the lifetime of the grate under heavy use. The modifications necessary to adapt the invention to any particular grate will be evident to anyone skilled in the art and to common sense. The only modifications required are such as to assure firm mounting of a grate on the grate platform by means of suitably shaped and placed receptacles or other means of attachment to the legs of the grate.

I claim:

1. A fireplace grate comprising:

(a) a base adapted to rest in a grate position within a fireplace;

(b) laterally spaced apart base rails supported on the base, the base rails extending substantially horizontally when the base is in the grate position and parallel to each other;

(c) a pullout platform slidably mounted on the base rails so that the platform is supported by the rails and may be moved between an operating position over the base and a loading position offset from the base;

(d) a grate structure for supporting fuel to be used in the fireplace; and (e) grate connecting means for connecting the grate structure to the pullout platform.

2. The fireplace grate of claim 1 wherein:

(a) the grate structure includes a grate support member connected to a plurality of grate cross members which are used for supporting fuel to be used in the fireplace; and (b) the base includes a heat conducting member in position to contact the grate support member substantially along its entire length when the pullout platform is in the operating position with the grate structure connected thereto.

3. The fireplace grate of claim 1 wherein:

(a) the base defines ash collecting area between the laterally spaced apart rails; and (b) the pullout platform includes at least one opening through which ash from fuel supported on the grate may fall into the ash collecting area in the base when the pullout platform is in the operating position with the grate structure supported thereon.

4. The fireplace grate of claim 1 wherein:

(a) each base rail comprises a flat plate of material having one free edge along the length of the plate, the free edge of each base rail extending generally parallel to the free edge of the other base rail; and (b) the pullout platform includes two laterally spaced apart channels, each channel adapted to slide over the free edge of a different base rail.

5. The fireplace grate of claim 1 wherein:

(a) the connecting means comprises at least two receptacles, each receptacle adapted to receive therein a different foot of the grate structure.

6. A fireplace grate support for supporting a fireplace grate, the support structure comprising:

(a) a base adapted to rest in a grate position within a fireplace;

(b) two laterally spaced apart base rails supported on the base, the base rails extending substantially horizontally when the base is in the grate position and parallel to each other;

(c) a pullout platform slidably mounted on the base rails so that the platform is supported by the base rails and may be moved between an operating position over the base and a loading position offset from the base; and (d) grate connecting means associated with the pullout platform for connecting a fireplace grate to the pullout platform.

7. The fireplace grate of claim 6 wherein:

(a) the grate structure includes a grate support member connected to a plurality of grate cross member which are used for supporting fuel to be used in the fireplace; and (b) the base includes a heat conducting member in position to contact the grate support member substantially along its entire length when the pullout platform is in the operating position with the grate connected thereto.

8. The fireplace grate of claim 6 wherein:

(a) the base defines ash collecting area between the laterally spaced apart rails; and (b) the pullout platform includes at least one opening through which ash from fuel supported on the grate may fall into the ash collecting area in the base when the pullout platform is in the operating position with the grate supported thereon.

9. The fireplace grate of claim 6 wherein:

(a) each base rail comprises a flat plate of material having one free edge along the length of the plate, the free edge of each base rail extending generally parallel to the free edge of the other base rail; and (b) the pullout platform includes two laterally spaced apart channels, each channel adapted to slide over the free edge of a different base rail.

10. The fireplace grate of claim 6 wherein:

(a) the connecting means comprises at least two receptacles, each receptacle adapted to receive therein a different foot of the fireplace grate.

* * * * *